US008653016B2

(12) United States Patent
Gessner et al.

(10) Patent No.: US 8,653,016 B2
(45) Date of Patent: Feb. 18, 2014

(54) BIODEGRADABLE CLEANING COMPOSITION

(75) Inventors: Suzanne Gessner, Ypsilanti, MI (US); Charles Kerobo, Southfield, MI (US); Sonia Patterson, Detroit, MI (US)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/511,963

(22) PCT Filed: Nov. 23, 2010

(86) PCT No.: PCT/US2010/057795

§ 371 (c)(1), (2), (4) Date: Sep. 7, 2012

(87) PCT Pub. No.: WO2011/066276

PCT Pub. Date: Jun. 3, 2011

(65) Prior Publication Data

US 2013/0005640 A1 Jan. 3, 2013

Related U.S. Application Data

(60) Provisional application No. 61/264,536, filed on Nov. 25, 2009.

(51) Int. Cl.
*C11D 1/72* (2006.01)

(52) U.S. Cl.
USPC ..... 510/421; 510/229; 510/434; 510/475; 510/480; 510/505

(58) Field of Classification Search
USPC ..... 510/229, 421, 434, 475, 480, 505
See application file for complete search history.

(56) References Cited

U.S. PATENT DOCUMENTS

| | | | |
|---|---|---|---|
| 3,953,352 | A | 4/1976 | Mizutani et al. |
| 4,013,579 | A | 3/1977 | Nakasone et al. |
| 4,043,931 | A | 8/1977 | Jeffrey et al. |
| 4,269,723 | A | 5/1981 | Barford et al. |
| 4,501,680 | A | 2/1985 | Aszman et al. |
| 4,587,030 | A | 5/1986 | Casey et al. |
| 4,722,802 | A | 2/1988 | Hutchings et al. |
| 4,749,509 | A | 6/1988 | Kacher |
| 4,820,449 | A | 4/1989 | Menke et al. |
| 4,911,858 | A | 3/1990 | Bunczk et al. |
| 4,911,859 | A | 3/1990 | Bunczk et al. |
| 4,999,869 | A | 3/1991 | Holland et al. |
| 5,049,302 | A | 9/1991 | Holland et al. |
| 5,061,393 | A | 10/1991 | Linares et al. |
| 5,340,495 | A | 8/1994 | Mulcahy et al. |
| 5,342,550 | A | 8/1994 | Burke et al. |
| 5,514,288 | A | 5/1996 | Holland et al. |
| 5,562,850 | A | 10/1996 | Woo et al. |
| 5,608,118 | A | 3/1997 | Dahlgren et al. |
| 5,661,121 | A | 8/1997 | Dahlgren et al. |
| 5,674,328 | A | 10/1997 | Mannava et al. |
| 5,698,041 | A | 12/1997 | Woo et al. |
| 5,733,856 | A | 3/1998 | Gopalkrishnan et al. |
| 5,750,482 | A | 5/1998 | Cummings |
| 5,789,369 | A | 8/1998 | Gopalkrishnan et al. |
| 6,008,176 | A | 12/1999 | Schneider et al. |
| 6,159,916 | A | 12/2000 | Robbins et al. |
| 6,187,738 | B1 | 2/2001 | Micciche et al. |
| 6,221,823 | B1 | 4/2001 | Crisanti et al. |
| 6,242,402 | B1 | 6/2001 | Robbins et al. |
| 6,315,835 | B1 | 11/2001 | Kerobo et al. |
| 6,420,329 | B1 | 7/2002 | Callaghan et al. |
| 6,455,486 | B1 | 9/2002 | Kerobo et al. |
| 6,559,112 | B2 | 5/2003 | Fox et al. |
| 6,627,590 | B1 | 9/2003 | Sherry et al. |
| 6,897,188 | B2 | 5/2005 | Gohl et al. |
| 7,189,685 | B2 | 3/2007 | Hubig et al. |
| 7,419,552 | B2 | 9/2008 | Ruland et al. |
| 7,503,333 | B2 | 3/2009 | Dailey et al. |
| 7,504,373 | B2 | 3/2009 | Dailey et al. |
| 7,608,576 | B2 | 10/2009 | Company et al. |
| 8,123,867 | B2 | 2/2012 | Tropsch |
| 2005/0170991 | A1 | 8/2005 | Ruland et al. |
| 2005/0181967 | A1 | 8/2005 | Ruland et al. |

FOREIGN PATENT DOCUMENTS

| | | | |
|---|---|---|---|
| DE | 102004040847 | A1 | 3/2006 |
| EP | 0669906 | B1 | 9/1995 |
| EP | 0669907 | B1 | 9/1995 |

(Continued)

OTHER PUBLICATIONS

English language abstract for JP 01-156399 extracted from the PAJ database on Sep. 6, 2013, 7 pages.
English language abstract for JP 05-302099 extracted from the PAJ database on Sep. 6, 2013, 15 pages.
English language abstract not available for JP 08-507824; however, see English language equivalent US 5,698,041. Original document extracted from the espacenet.com database on Sep. 6, 2013, 40 pages.
English language abstract not available for JP 08-511255; however, see English language equivalent US 6,008,176. Original document extracted from the espacenet.com database on Sep. 6, 2013, 43 pages.

(Continued)

*Primary Examiner* — Brian P Mruk
(74) *Attorney, Agent, or Firm* — Howard & Howard Attorneys PLLC

(57) ABSTRACT

The present invention provides a biodegradable cleaning composition that includes a surfactant component including an ethoxylated 2-propyl heptanol, a chelating component including a tri-sodium salt of methylglycinediacetic acid and an emulsifier component including an ethoxylated hexanol having the formula $C_6H_{13}O(CH_2CH_2O)H$. The ethoxylated 2-propyl heptanol has the formula $C_5H_{11}CH(C_3H_7)CH_2O(C_2H_4O)_pH$, wherein p is a number of from 3 to 6. The composition also includes water and an acid component to establish a pH of the composition at less than 2. The composition is substantially free of solvents thereby reducing emission of volatile organic compounds and reducing potential environmental pollution and health hazards. The composition is also effective in removing rust, lime soap, and metal salts of fatty acids from hard surfaces including metal, vinyl, and fiberglass.

23 Claims, No Drawings

(56) References Cited

FOREIGN PATENT DOCUMENTS

| | | | | | |
|---|---|---|---|---|---|
| JP | 01-156399 | A | | 6/1989 | |
| JP | 05-302099 | A | | 11/1993 | |
| JP | 08-507824 | A | | 8/1996 | |
| JP | 08-511255 | A | | 11/1996 | |
| JP | 11-509782 | A | | 8/1999 | |
| JP | 2003-336092 | A | | 11/2003 | |
| JP | 2004-035755 | A | | 2/2004 | |
| JP | 2004-091686 | A | | 3/2004 | |
| JP | 2006-525408 | A | | 11/2006 | |
| JP | 2010-525128 | A | | 7/2010 | |
| WO | WO 94/11330 | A1 | | 5/1994 | |
| WO | WO 94/11331 | A1 | | 5/1994 | |
| WO | WO 03/091191 | A1 | | 11/2003 | |
| WO | WO 2004/099355 | A1 | | 11/2004 | |
| WO | WO 2008/132133 | | * | 11/2008 | ..... C11D 1/825 |
| WO | WO 2009/026956 | A1 | | 3/2009 | |

OTHER PUBLICATIONS

English language abstract not available for JP 11-509782; however, see English language equivalent US 5,674,328. Original document extracted from the espacenet.com database on Sep. 6, 2013, 29 pages.

English language abstract not available for JP 2006-525408; however, see English language equivalent US 7,608,576. Original document extracted from the espacenet.com database on Sep. 6, 2013, 23 pages.

English language abstract not available for JP 2010-525128; however, see English language equivalent US 8,123,867. Original document extracted from the espacenet.com database on Sep. 6, 2013, 40 pages.

English language abstract and machine-assisted English translation for DE 102004040847 extracted from the espacenet.com database on Sep. 28, 2012, 25 pages.

English language abstract and machine-assisted English translation for JP 2003-336092 extracted from the PAJ database on Nov. 16, 2012, 40 pages.

English language abstract and machine-assisted English translation for JP 2004-035755 extracted from the PAJ database on Nov. 16, 2012, 47 pages.

English language abstract and machine-assisted English translation for JP 2004-091686 extracted from the espacenet.com database on Nov. 16, 2012, 83 pages.

English language abstract for WO 03/091191 extracted from the espacenet.com database on Nov. 14, 2012, 33 pages.

International Search Report for Application No. PCT/US2010/057795 dated Mar. 22, 2011, 5 pages.

* cited by examiner

BIODEGRADABLE CLEANING COMPOSITION

RELATED APPLICATIONS

This application claims priority to and all the advantages of International Patent Application No. PCT/US2010/057795, filed on Nov. 23, 2010, which claims priority to U.S. Provisional Patent Application No. 61/264,536, filed on Nov. 25, 2009.

FIELD OF THE INVENTION

The present invention generally relates to a biodegradable cleaning composition. The composition includes a surfactant component including an alkoxylated 2-propyl heptanol, a chelating component, and an emulsifier component.

DESCRIPTION OF THE RELATED ART

Cleaning compositions are well known in the art, especially those used to clean hard surfaces. These cleaning compositions can be basic or acidic and are typically used to dissolve rust, lime soap, and calcium and magnesium salts of fatty acids resulting from reactions of calcium and magnesium ions found in hard water with various soaps. The rust, lime soap, and salts are usually combined with mineral deposits, in addition to dirt, oil, and grease, thereby making removal from the hard surfaces difficult. Many of these cleaning compositions include organic cleaning solvents, detergent surfactants, and abrasives and, as a result, tend to emit volatile organic compounds (VOCs) and present pollution and environmental hazards when used and discarded. Additionally, many of these cleaning compositions are not effective when used on hard surfaces such as glass, metal, vinyl and fiberglass. Further, these cleaning compositions tend to dull the hard surfaces, thereby reducing consumer satisfaction and reducing marketability.

One particular cleaning composition, disclosed in U.S. Pat. No. 6,627,590 to Sherry et al., includes an alkyl sulfate surfactant, a hydrophobic cleaning solvent, a carboxylic acid, a non-ionic detergent surfactant, a hydrophilic polymer, and an aqueous solvent, and also has a pH of from 2 to 5. The hydrophobic cleaning solvent contributes to emission of VOCs and reduces the ability of the composition to biodegrade. Additionally, the non-ionic detergent surfactant includes a mixture of alkoxylated alcohols having from 6 to 16 carbon atoms that are subject to chemical degradation, i.e., the alkoxylated alcohols have a tendency to break down into other less effective compounds. This reduces efficiency of the composition. Further, the hydrophilic polymer includes styrenes, pyrrolidones, and pyridines, which are known toxins and may be environmentally hazardous.

Although the known cleaning compositions, such as the composition of the '590 patent, are widely used, there remains an opportunity to improve cleaning efficiency of hard surfaces and to reduce environmental impact realized when using these known cleaning compositions. There also remains an opportunity to form a cleaning composition that includes chemically stable components that do not have tendencies to break down into other less effective compounds. There further remains an opportunity to form a cleaning composition that effectively removes rust, lime soap, and metal salts of fatty acids while simultaneously being biodegradable and substantially free of solvents such that emissions of VOCs are reduced.

SUMMARY OF THE INVENTION AND ADVANTAGES

The present invention provides a cleaning composition. The composition includes a surfactant component including an alkoxylated 2-propyl heptanol. The alkoxylated 2-propyl heptanol has the formula $C_5H_{11}CH(C_3H_7)CH_2O(B)_r(C_2H_4O)_pH$, wherein B is an alkyleneoxy group having from 3 to 4 carbon atoms, r is a number of from 0 to 6, and p is a number of from 1 to 10. The composition also includes a chelating component including at least two carboxyl moieties. Additionally, the composition includes an emulsifier component including an ethoxylated hexanol. The ethoxylated hexanol has the formula $C_6H_{13}O(CH_2CH_2O)_nH$, wherein n is a number of from 1 to 9.

In one embodiment of the present invention, the cleaning composition has a pH of less than 1 and the alkoxylated 2-propyl heptanol has the formula $C_5H_{11}CH(C_3H_7)CH_2O(C_2H_4O)_pH$, wherein p is a number of from 1 to 10. In another embodiment, the cleaning composition also has a pH of less than 1 and the alkoxylated 2-propyl heptanol includes a first and a second alkoxylated 2-propyl heptanol. The first alkoxylated 2-propyl heptanol has the formula $C_5H_{11}CH(C_3H_7)CH_2O(C_2H_4O)_3H$ and the second alkoxylated 2-propyl heptanol has the formula $C_5H_{11}CH(C_3H_7)CH_2O(C_2H_4O)_6H$.

The composition is effective in removing rust, lime soap, and metal salts of fatty acids from hard surfaces. The composition is also biodegradable and, as a result, is environmentally friendly and presents a reduced risk of environmental pollution when used and discarded. The at least two carboxyl groups of the chelating component bind, i.e., sequester, metal ions on the hard surfaces and effect removal of lime soap and other mineral deposits, inhibit crystal growth to minimize crystal encrustation, and disperse lime soap and particulate soil. Sequestration of the metal ions by the chelating component softens water and increases cleaning effectiveness of the cleaning composition. Also, sequestration minimizes precipitation of salts thereby further increasing cleaning effectiveness. The emulsifier component is surface active and promotes suspension of hydrophobic dirt and residues in the composition, thereby increasing a cleaning efficiency of the composition.

DETAILED DESCRIPTION OF THE INVENTION

The instant invention provides a cleaning composition, hereafter simply referred to as "composition." The composition is preferably biodegrable and may be effectively used to remove stains and residues, such as rust, lime soap, and metal salts of fatty acids, from surfaces. The composition may be used to remove stains and residues from hard surfaces in both commercial and residential settings. Non-limiting examples of hard surfaces are those found in kitchens and bathrooms, on walls and floors, in showers and bathtubs, on countertops and cabinets, and on marble, glass, metal, vinyl, fiberglass, ceramic, granite, concrete, acrylic, Formica®, Silestone®, Conan®, and laminated surfaces. It is also contemplated that the composition may be applied in outdoor environments on exterior surfaces such as on driveways, patios, siding, decking, and the like. The terminology "biodegradable," as referenced herein, refers to a tendency of the composition to be chemically degraded via natural effectors such as soil bacteria, weather, plants and/or animals. The biodegradability of the composition reduces a possibility of pollution and formation of environmental hazards and is dependent on components of the composition.

The composition includes three components including a surfactant component, a chelating component, and an emulsifier component. The surfactant component includes an alkoxylated 2-propyl heptanol having the formula:

$$C_5H_{11}CH(C_3H_7)CH_2O(B)_r(C_2H_4O)_pH$$

wherein B is an alkyleneoxy group having from 3 to 4 carbon atoms, r is a number of from 0 to 6, and p is a number of from 1 to 10. The alkyleneoxy group may include, but is not limited to, ethyleneoxy groups, propyleneoxy groups, butyleneoxy groups, and combinations thereof. The butyleneoxy groups may include any or all of 1,2-butylene oxide groups, 2,3-butylene oxide groups, and isobutylene oxide groups. The alkyleneoxy group may be any known in the art, as selected by one of skill in the art. In one embodiment, r is 0 and p is a number of from 3 to 6. In another embodiment, the alkoxylated 2-propyl heptanol has the formula $C_5H_{11}CH(C_3H_7)CH_2O(C_2H_4O)_pH$, wherein p is a number of from 1 to 10

The surfactant component may consist essentially of the alkoxylated 2-propyl heptanol. Alternatively, the surfactant component may consist of the alkoxylated 2-propyl heptanol. The alkoxylated 2-propyl heptanol may include a blend of alkoxylated 2-propyl heptanols including any known in the art. In one embodiment, the alkoxylated 2-propyl heptanol includes a first alkoxylated 2-propyl heptanol wherein r is 0 and p is 3 and a second alkoxylated 2-propyl heptanol wherein r is 0 and p is 6. Alternatively, the alkoxylated 2-propyl heptanol may consist essentially of the first alkoxylated 2-propyl heptanol wherein r is 0 and p is 3 and the second alkoxylated 2-propyl heptanol wherein r is 0 and p is 6. Further, the alkoxylated 2-propyl heptanol may consist of the first alkoxylated 2-propyl heptanol wherein r is 0 and p is 3 and the second alkoxylated 2-propyl heptanol wherein r is 0 and p is 6. In one embodiment, the first alkoxylated 2-propyl heptanol is present in a ratio of 1:2 with the second alkoxylated 2-propyl heptanol.

It is contemplated that the alkyleneoxy group of the alkoxylated 2-propyl heptanol may include two or three separate blocks of akyleneoxides in a diblock and/or a triblock configuration, respectively. The diblock and/or triblock configurations of the alkyleneoxy group may include ethyleneoxy groups, propyleneoxy groups, butyleneoxy groups, and combinations thereof. In one embodiment, the diblock configurations include only ethylene oxide. In another embodiment, the diblock configurations include only propylene oxide. Similarly, the triblock configurations may include only ethylene oxide or only propylene oxide.

The surfactant component preferably includes a hydrophilic-lipophilic balance (HLB of from 7 to 16, more preferably of from 7 to 13, and most preferably of from 7 to 12. The surfactant component is preferably present in the composition in an amount of from 0.3 to 10, more preferably of from 1 to 5, and most preferably of from 1 to 4, parts by weight per 100 parts by weight of the composition. However, the surfactant component may be present in any amount depending on the desired use of the composition as determined by one skilled in the art. Suitable non-limiting examples of surfactant components are commercially available from BASF Corporation. The alkoxylated 2-propyl heptanol may be prepared by any method known in the art. Typically, the alkoxylated 2-propyl heptanol is prepared by using an alcohol (i.e., 2-propyl heptanol) as an initiator, and polymerizing an alkylene oxide or a mixture of alkylene oxides onto the initiator to form the alkoxylated 2-propyl heptanol. In one embodiment, the alkoxylated 2-propyl heptanol is prepared according to the method set forth in U.S. Pat. No. 5,661,121, incorporated herein by reference.

Referring now to the chelating component first introduced above, the chelating component has at least two carboxyl moieties (C═O). The two carboxyl moieties are believed to chelate metal ions such as calcium and magnesium ions (i.e., the oxygen atoms bond to the metal ions simultaneously through more than one donor atom), thereby increasing the cleaning ability of the composition. Specifically, it is believed that the chelating component including the carboxyl moieties acts as a Lewis base forming coordinate bonds between the oxygen atoms of the carboxyl moieties and the metal ions, which act as Lewis acids. By forming the coordinate bonds, the carboxyl moieties are believed to sequester the metal ions on the hard surfaces and effect removal of lime soap and other mineral deposits, inhibit crystal growth to minimize crystal encrustation, and disperse lime soap and particulate soil. Sequestration of the metal ions by the chelating component is believed to soften water and increase cleaning effectiveness of the composition. Also, sequestration is believed to minimize precipitation of salts thereby further increasing cleaning effectiveness.

The chelating component may include an acetic acid. More specifically, the acetic acid may include methylglycinediacetic acid. Alternatively, the chelating component may include a salt of an acetic acid or may consist essentially of the salt of the acetic acid. It is also contemplated that the chelating component may consist of the salt of the acetic acid. In one embodiment, the chelating component includes a first salt of the acetic acid and a second salt of the acetic acid that is different from the first salt. The salt of the acetic acid may include di- and/or tri-sodium salts of methylglycinediacetic acid, commercially available from BASF Corporation under the trade name of Trilon® M. For descriptive purposes only, a chemical structure of methylglycinediacetic acid is shown below:

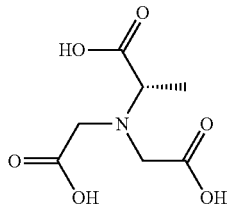

Methylglycinediacetic acid

Preferably, the chelating component has a weight average molecular weight of from 100 to 600, more preferably of from 190 to 505, and most preferably of from 270 to 275, g/mol. Further, the chelating component is preferably present in an amount of from 1 to 10, more preferably of from 1 to 5, and most preferably of from 2 to 4, parts by weight per 100 parts by weight of the composition.

The composition also includes the emulsifier component, as first introduced above. The emulsifier component includes an ethoxylated hexanol having the formula:

$$C_6H_{13}O(CH_2CH_2O)_nH$$

wherein n is a number of from 1 to 9. In one embodiment, n is 1. In another embodiment, n is of from 4 to 5. The emulsifier component may consist essentially of the ethoxylated hexanol or may consist of the ethoxylated hexanol. Alternatively, the ethoxylated hexanol may include a first ethoxylated hexanol and a second ethoxylated hexanol different from the first. Preferably, the emulsifier component is present in an amount of from 1 to 10, more preferably of from 2 to 4, and most preferably of from 2 to 3, parts by weight per 100 parts by weight of the composition. It is contemplated that the ethoxylated hexanol may be prepared in a similar way as the alkoxylated 2-propyl heptanol except that the hexanol would act as the initiator. Suitable non-limiting examples of the ethoxylated hexanol are commercially available from BASF Corporation.

In addition to including the aforementioned components, the composition also preferably has a pH of less than 2. In one embodiment, the composition has a pH of less than 1. It is contemplated that the composition may have a pH of zero or may have a negative pH. However, the composition is not limited by the pH and may have a pH greater than 2 if desired, as determined by one of skill in the art.

The pH of the composition is directly influenced by a presence of acid and water in the composition. As such, the composition may include an acid component. The acid component may include an acid selected from the group of nitric acid, hydrochloric acid, sulfuric acid, perchloric acid, hydrobromic acid, hydriodic acid, methane sulfonic acid, glycolic acid, urea, phosphoric acid, and combinations thereof. However, the acid may be any known in the art. Preferably, the acid component is present in the composition in an amount such that the desired pH of the composition is achieved.

The composition may also include water, as first introduced above. The water is preferably present in an amount of from 80 to 90 and more preferably of from 80 to 86, parts by weight per 100 parts by weight of the composition. In one embodiment, the composition is concentrated and includes an amount of water of less than 80 parts by weight per 100 parts by weight of the composition. In another embodiment, the composition is diluted and includes an amount of water of greater than 90 parts by weight per 100 parts by weight of the composition. The amount of water may be adjusted by one of skill in the art depending on desired usage of the composition.

Preferably, the composition is substantially free of solvents such as organic solvents including, but not limited to, acetone, benzene, toluene, ethers, acetates, volatile organic solvents, and combinations thereof. The composition is preferably substantially free of solvents to reduce evaporation of volatile organic compounds and reduce potential environmental pollution. The terminology "substantially free" refers to an amount of solvents present in the composition of less than 1 part by weight per 100 parts by weight of the composition. In one embodiment, the composition is completely free of the solvents.

EXAMPLES

A series of compositions (Compositions 1-4) are formed according to the present invention. Specifically, amounts of the Surfactant Component, the Chelating Component, and the Emulsifier Component are added to a vessel and mixed. Additionally, amounts of the Acid Component and Water are also added to the vessel and mixed to form the Compositions 1-4, each with a variable pH. After mixing, samples of each of the Compositions 1-4 are applied to soiled ceramic tiles to determine a Degree of Lime Soap Removal, according to ASTM D-4488, measured on a scale of 0-5, with 5 representing the most effective Degree of Lime Soap Removal. Additionally, a Comparative Composition 1 is also measured for Degree of Lime Soap Removal via the same method. The Comparative Composition 1 is not formed according to the present invention but rather is an acidic cleaning compound that is commercially available. Amounts of each of the components and the water are set forth in Table 1 below, wherein all amounts are in weight percent unless otherwise indicated.

TABLE 1

| Components | | Composition 1 | Composition 2 | Composition 3 |
|---|---|---|---|---|
| Surfactant Component | Surfactant Component 1 | 1 | 1 | — |
| | Surfactant Component 2 | 2 | 2 | 2.93 |
| Chelating Component | | 2 | 2 | 1.95 |
| Emulsifier Component | | 2.75 | 2.54 | 2.69 |
| Acid Component | Acid 1 | — | 4.4 | 2.4 |
| | Acid 2 | 3.36 | — | — |
| | Acid 3 | — | — | 3.28 |
| | Acid 4 | — | 6.09 | — |
| Water | | 88.89 | 81.97 | 86.75 |
| Total | | 100 | 100 | 100 |
| pH | | 0.66 | 0.65 | 0.75 |
| Degree of Lime Soap Removal (0-5 Scale) | | 3 | 3 | 4 |

| Components | | Composition 4 | Comparative Composition 1 |
|---|---|---|---|
| Surfactant Component | Surfactant Component 1 | — | — |
| | Surfactant Component 2 | 3 | — |
| Chelating Component | | 2 | — |
| Emulsifier Component | | 2.54 | — |
| Acid Component | Acid 1 | 4.4 | — |
| | Acid 2 | — | — |
| | Acid 3 | — | — |
| | Acid 4 | 6.09 | Unknown |
| Water | | 81.97 | Unknown |
| Total | | 100 | N/A |
| pH | | <1 | 0.52 |
| Degree of Lime Soap Removal (0-5 Scale) | | 3 | 1 |

The Surfactant Component 1 is an ethoxylated 2-propyl heptanol having the formula $C_5H_{11}CH(C_3H_7)CH_2O(C_2H_4O)_3H$ and is commercially available from BASF Corporation.

The Surfactant Component 2 is an ethoxylated 2-propyl heptanol having the formula $C_5H_{11}CH(C_3H_7)CH_2O(C_2H_4O)_6H$ and is commercially available from BASF Corporation.

The Chelating Component is a tri-sodium salt of methylglycinediacetic acid and is commercially available from BASF Corporation.

The Emulsifier Component is an ethoxylated hexanol having the formula $C_6H_{13}O(CH_2CH_2O)_1H$ and is commercially available from BASF Corporation.

The Acid 1 is hydrochloric acid.

The Acid 2 is methylsulfonic acid.

The Acid 3 is glycolic acid.

The Acid 4 is urea.

As first introduced above, the Compositions 1 through 4 and the Comparative Composition 1 are measured for the Degree of Lime Soap Removal according to ASTM D-4488. In accordance with ASTM D-4488, reconstituted soil is formulated and is used to soil the tiles before cleaning. The reconstituted soil includes 4.5% by weight of parent soil, 9.00% by weight of hard water including approximately 20,000 ppm of a 2:1 ratio of calcium chloride dihydrate to magnesium chloride hexahydrate, 0.77 percent by weight of HCl, and 85.73 percent by weight of acetone.

Specifically, the parent soil is formed by combining Ivory soap, shampoo, clay, sebum, and hard water in a beaker to form a mixture. The mixture is stirred with a three-blade propeller mixer and heated to approximately 45° C.-50° C. until a smooth suspension is achieved. The suspension is filtered through a Buchner funnel fitted with Whatman #1 filter paper. A filtrate soil resulting from the filtering is then resuspended in deionized water using the same volume of water that is used to make the parent soil. A filtrate cake, also resulting from the filtering, is dried overnight in an oven heated to approximately 45° C. The dried filtrate cake is then pulverized and kept in a closed container away from ambient moisture and is then used in a formulation for reconstituted soil. The reconstituted soil is formed by mixing the dried filtrate cake, i.e., the parent soil, with hard water, hydrochloric acid, and acetone.

After formation of the reconstituted soil from the parent soil, and in accordance with ASTM D-4488, the reconstituted soil is applied to the ceramic tiles and at least partially scrubbed off with application of the Compositions 1 through 4 and the Comparative Composition 1, using a Gardener Scrubber, as is known in the art. The Degree of Lime Soap Removal is measured on a scale of from 0 to 5, with 5 indicating total removal of the reconstituted soil from the ceramic tiles, as determined visually.

The results of the evaluations of the Degree of Lime Soap Removal indicate that the Compositions 1 through 4 are more efficient in removing the reconstituted soil from the ceramic tiles than the Comparative Composition 1. Without intending to be limited by any particular theory, it is believed that synergistic interaction of each of the surfactant component, the chelating component, and the emulsifier component contribute to the efficiency of the Compositions 1 through 4. These results also suggest the usefulness of the Compositions 1 through 4 in many applications that include hard surfaces such as in both residential and commercial settings.

Obviously, many modifications and variations of the present invention are possible in light of the above teachings. The invention may be practiced otherwise than as specifically described within the scope of the appended claims.

What is claimed is:

1. A cleaning composition comprising having a pH of less than 2 and:

A. a surfactant component comprising an alkoxylated 2-propyl heptanol having the formula;

$$C_5H_{11}CH(C_3H_7)CH_2O(B)_r(C_2H_4O)_pH$$

B. wherein B is an alkyleneoxy group having from 3 to 4 carbon atoms, r is a number of from 0 to 6, and p is a number of from 1 to 10;

C. a chelating component comprising at least two carboxyl moieties; and

D. an emulsifier component comprising an ethoxylated hexanol having the formula;

$$C_6H_{13}O(CH_2CH_2O)_nH$$

wherein n is a number of from 1 to 9.

2. A composition as set forth in claim 1 wherein r is 0 and p is a number of from 3 to 6.

3. A composition as set forth in claim 1 wherein said alkoxylated 2-propyl heptanol comprises a first alkoxylated 2-propyl heptanol wherein r is 0 and p is 3 and a second alkoxylated 2-propyl heptanol wherein r is 0 and p is 6.

4. A composition as set forth in claim 3 wherein said alkoxylated 2-propyl heptanol consists essentially of said first alkoxylated 2-propyl heptanol and said second alkoxylated 2-propyl heptanol.

5. A composition as set forth in claim 1 wherein said surfactant component is present in an amount of from 0.3 to 10 parts by weight per 100 parts by weight of said composition.

6. A composition as set forth in claim 1 wherein n is 1.

7. A composition as set forth in claim 1 wherein n is a number from 4 to 5.

8. A composition as set forth in claim 1 wherein said emulsifier component is present in an amount of from 2 to 4 parts by weight per 100 parts by weight of said composition.

9. A composition as set forth in claim 1 wherein said chelating component comprises a salt of an acetic acid.

10. A composition as set forth in claim 9 wherein said salt comprises a sodium salt of methylglycinediacetic acid.

11. A composition as set forth in claim 1 wherein said chelating component consists essentially of a salt of an acetic acid.

12. A composition as set forth in claim 1 wherein said chelating component is present in an amount of from 1 to 5 parts by weight per 100 parts by weight of said composition.

13. A composition as set forth in claim 1 further comprising an acid component.

14. A composition as set forth in claim 1 having a pH of less than 1 and substantially free of solvents, wherein said alkoxylated 2-propyl heptanol consists essentially of a first alkoxylated 2-propyl heptanol wherein r is 0 and p is 3 and a second alkoxylated 2-propyl heptanol wherein r is 0 and p is 6 and is present in an amount of from 1 to 4 parts by weight per 100 parts by weight of said composition, wherein said chelating agent comprises a tri-sodium salt of methylglycinediacetic acid and is present in an amount of from 2 to 4 parts by weight per 100 parts by weight of said composition, and wherein said emulsifier component consists essentially of said ethoxylated hexanol and is present in an amount of from 2 to 3 parts by weight per 100 parts by weight of said composition.

15. A cleaning composition having a pH of less than 1 and comprising:

A. a surfactant component comprising an alkoxylated 2-propyl heptanol having the formula;

$$C_5H_{11}CH(C_3H_7)CH_2O(C_2H_4O)_pH$$

wherein p is a number of from 1 to 10;

B. a chelating component comprising at least two carboxyl moieties; and

C. an emulsifier component comprising an ethoxylated hexanol having the formula;

$$C_6H_{13}O(CH_2CH_2O)_nH$$

wherein n is a number of from 1 to 9.

16. A composition as set forth in claim 15 wherein said alkoxylated 2-propyl heptanol consists essentially of a first alkoxylated 2-propyl heptanol wherein p is 3 and a second alkoxylated 2-propyl heptanol wherein p is 6.

17. A composition as set forth in claim 15 wherein said chelating component comprises a salt of an acetic acid.

18. A composition as set forth in claim 15 wherein n is a number of from 4 to 5.

19. A composition as set forth in claim 15 wherein said surfactant component is present in an amount of from 0.3 to 10 parts by weight per 100 parts by weight of said composition.

20. A composition as set forth in claim 19 wherein said emulsifier component is present in an amount of from 2 to 4 parts by weight per 100 parts by weight of said composition.

21. A cleaning composition substantially free of solvents and having a pH of less than 1, said composition comprising:

A. a surfactant component comprising an alkoxylated 2-propyl heptanol comprising;

(i) a first alkoxylated 2-propyl heptanol having the formula, $$C_5H_{11}CH(C_3H_7)CH_2O(C_2H_4O)_3H$$

and (ii) a second alkoxylated 2-propyl heptanol having the formula, $$C_5H_{11}CH(C_3H_7)CH_2O(C_2H_4O)_6H,$$

B. a chelating component comprising at least two carboxyl moieties, and

C. an emulsifier component comprising an ethoxylated hexanol having the formula;

$$C_6H_{13}O(CH_2CH_2O)_nH$$

wherein n is a number of from 4 to 5.

22. A composition as set forth in claim 21 wherein said alkoxylated 2-propyl heptanol consists essentially of said first and second alkoxylated 2-propyl heptanols.

23. A composition as set forth in claim 21 wherein said chelating component comprises a salt of an acetic acid.

* * * * *

UNITED STATES PATENT AND TRADEMARK OFFICE

CERTIFICATE OF CORRECTION

PATENT NO. : 8,653,016 B2
APPLICATION NO. : 13/511963
DATED : February 18, 2014
INVENTOR(S) : Suzanne Gessner et al.

It is certified that error appears in the above-identified patent and that said Letters Patent is hereby corrected as shown below:

IN THE CLAIMS:

Column 7, line 45, "A cleaning composition comprising having a pH of less than 2 and:" should read as -- A cleaning composition having a pH of less than 2 and comprising: --

Signed and Sealed this
Thirty-first Day of March, 2015

Michelle K. Lee

Michelle K. Lee
*Director of the United States Patent and Trademark Office*